US005678795A

United States Patent [19]

Henry et al.

[11] Patent Number: 5,678,795

[45] Date of Patent: Oct. 21, 1997

[54] SHELF BRACKET

[75] Inventors: Jack C. Henry; John J. Henry, both of Downingtown, Pa.

[73] Assignee: Graphex Incorporated, Exton, Pa.

[21] Appl. No.: 444,988

[22] Filed: May 19, 1995

[51] Int. Cl.[6] ..... A47B 96/06

[52] U.S. Cl. ..... 248/220.41; 248/301; 211/57.1; 211/59.1

[58] Field of Search ..... 248/220.41, 220.21, 248/220.31, 220.42, 221.11, 225.21, 316.7, 224.8, 225.11, 301; 211/57.1, 54.1, 59.1, 113, 118

[56] References Cited

U.S. PATENT DOCUMENTS

| | | | |
|---|---|---|---|
| D. 300,301 | 3/1989 | Furst et al. | D8/363 |
| 2,766,958 | 10/1956 | Levy | 248/220.41 |
| 2,810,539 | 10/1957 | Levy et al. | 248/220.41 |
| 3,481,482 | 12/1969 | Wilkens | 211/57 |
| 3,677,415 | 7/1972 | Radek | 248/220.42 |
| 4,889,304 | 12/1989 | Glickman et al. | 248/222.11 |
| 5,088,606 | 2/1992 | Boas | 248/220.31 |
| 5,275,367 | 1/1994 | Frye | 248/316.7 |
| 5,346,166 | 9/1994 | Valiulis | 248/220.41 |
| 5,429,334 | 7/1995 | Hutchison | 248/220.21 |

*Primary Examiner*—Ramon O. Ramirez
*Assistant Examiner*—Anita M. King
*Attorney, Agent, or Firm*—John S. Munday; Stephen G. Stanton

[57] ABSTRACT

A device useful for displaying clip strips having a plurality of individual products thereon and having both a hole and a slot. The device engages a shelf having a plurality of holes on its top surface. The device includes an elongated body having a shelf engaging end and an outer terminal end extending from the shelf. The shelf engaging end includes a pair of spaced apart tabs extending away from the body configured to engage a pair of shelf holes and present a flat surface against the underside of the shelf. The tabs including a flange for mounting the tabs on the body and providing a surface of engagement for contact with the top surface of the shelf. Located proximate the outer terminal end of the body is a platform for supporting at least two hooks extending both out from the body to space the product from the body and upward for engaging products. The platform includes a slot engaging axially aligned horizontally aligned rib for engaging the product to prevent rotational movement of the product about the hook. The body also includes a central passageway axially aligned along the length of the body to present an axially aligned receptacle for engaging and detachably holding advertising media such as card stock having printing thereon. The central passageway includes at least one rib extending slightly past the axial center of the passageway to prevent inadvertent removal of the card stock.

9 Claims, 1 Drawing Sheet

SHELF BRACKET

FIELD OF THE INVENTION

The present invention relates to a shelf bracket. More particularly the present invention relates to a bracket useful for displaying products such as clip strips from a shelf having a plurality of holes thereon.

BACKGROUND OF THE INVENTION

Displaying products for sale has become more common as shoppers have less time to review all of the items on the store shelves. This is particularly true when the item offered for sale is an impulse item or when the item is one that is not routinely on the typical shopping list. It is desirable to present products to customers, particularly in supermarkets and drug stores, that stand out and virtually call for attention. Marketing studies indicate that point of sale advertising is effective in increasing sales, particularly when impulse buying is targeted.

One such method for attracting impulse and latent need buying in stores is mount the products on what are known as clip strips. Clip strips are elongated paper or plastic strips that contain a number of items removeably attached to the strip, whereby the customer selects one or more products and leaves those that are not needed. One advantage of clip strip marketing is that the customer can't readily attach the product back and will, often, purchase the item. However, in order to be effective, clip strips must be visible to the customer as she or he walks past the display. Also, it is desirable that the customer be given some advance suggestion to look for the clip strip as the aisle is perused.

No such device currently is available for clip strip sales efforts. Presently all that has been done is to hang the clip strip from a hook on the shelf. No bracket or other device for attaching point of sale clip strip like devices has been employed in the retail industry.

Furst et al Design Patent D 300,301 covers a display hook that has unique ornamental features. Its functional features disclose a plate that engages holes in a surface using L-shaped hooks. Extending from the hook is an arm that includes two generally cylindrical members and a fanciful hook portion on the terminal end of the arm. The functional features are not covered by a design patent, but it is clear that this design is intended to be attached to a vertical wall so that items might be loosely hung or balanced on the device. There is no way that this device could effectively engage a clip strip.

Glickman et al U.S. Pat. No. 4,889,304 is specifically designed for panel board rather than shelves, which is why this patent shows upturned L-shaped hooks or lugs. Again there is no suggestion that a clip strip could be hung from a horizontal shelf in a manner that would effectively display the products to be hung from the device. Glickman requires a locking key 30 that prevents removal of the device one it is installed.

Levy U.S. Pat. No. 2,766,958 teaches a device for attachment to upright perforated wallboard where a planar base plate bears against the face of the panel while both a rod and a clip extend from the front of the plate at part of the combination. Levy et al U.S. Pat. No. 2,810,539 is an improvement on that design, focusing on a means for preventing damage to the perforations in the display panel. Neither Levy patent remotely relates to displays of products on horizontal shelving.

Finally, Wilkens U.S. Pat. No. 3,481,482 discloses a conventional rod shaped bracket or hook that includes a pilfer-proof feature.

In summary, none of the prior art directly addresses the problem of effectively displaying products from horizontal shelves. Moreover, the devices are not easily modified for use with such shelves without departing from the spirit of those patents. In addition, none of the known prior art permits the inclusion of advertising material in cooperation with the shelf bracket to provide incentive for investigation of the product so conveniently available for inspection.

Accordingly, it is an object of the present invention to provide a to provide a shelf bracket that not only holds a clip strip or other product conveying component on the shelf but also permits the store to advertise the presence of the product and attract impulse buying.

Mother object of this invention is to provide a device which is a sturdy, reliable support for clip strips and the like so that customers are attracted to a nicely presented product and can take one or more of the products on the strip clip.

Yet another object of the present invention is to provide a device that permits display over a long period of time without damage to the product or to the display holding the product.

Other objects will appear hereinafter.

SUMMARY OF THE INVENTION

It has now been discovered that the above and other objects of the present invention may be accomplished in the following manner. Specifically, the present invention provides a device useful for displaying products from a shelf having a plurality of holes on its top surface.

The device includes an elongated body having a shelf engaging end and an outer terminal end extending from the shelf. Located on the shelf engaging end is a shelf engaging means including a pair of spaced apart tabs extending away from the body and configured to engage a pair of shelf holes in the shelf. The tabs present a flat surface against the underside of the shelf and include flange means for mounting the tabs on the body while also providing a surface of engagement for contact with the top surface of the shelf.

Located proximate the outer terminal end of the body is a platform. The platform supports at least two hooks extending both out from the body and upward for engaging products. The platform includes slot engaging means, in the form of a horizontally extending rib for engaging the product to prevent rotational movement of the product about the hook. In a preferred embodiment, the product is a clip strip having a plurality of individual products attached thereon. The top of the clip strip includes a hole and a slot such that the hook engages the hole and the platform's horizontally aligned rib engages the slot to align the clip strip to substantially prolong the life of the clip strips and prevent them from looking worn or used until the products have been sold.

Since the purpose of the present invention is not only to hold the clip strip or other product conveying component but also to advertise the presence of the product and attract impulse buying, the product should be visible as a potential customer walks along the aisle. Toward that end, it is preferred that the elongated body extend out from the shelf by at least twice the width of the clip strip. This will insure visibility without obstructing the path in the aisle. To insure that the product receives maximum visibility, the hook and slot engaging means are positioned to align the clip strip with the outer terminal end of the body.

The body also includes including a central passageway axially aligned with the length of the body to present an axially aligned receptacle for engaging and detachably holding advertising media. The central passageway includes at least one advertising media engaging rib extending slightly past the axial center of the passageway to prevent inadvertent removal of the media. Preferably the passageway includes a plurality of advertising media engaging ribs so that, for example, when the advertising media is card stock having printing thereon, it is slightly displaced off axis to frictionally engage the without presenting a distorted appearance.

One of the major advantages of the present invention is that it provides a sturdy, reliable support for clip strips and the like so that customers are attracted to a nicely presented product and can take one or more of the products on the strip clip. The tabs that engage the underside of the shelf through the holes in the shelf have a flat portion that provides stability. So too, the flange means engages the top surface of the shelf to further stabilize the device against movement in the holes when the device is inadvertently or intentionally disturbed, such as when accidentally bumped or when product is removed. It is desirable for maximum stability that the surface of engagement on the flange is at least three times larger than the combined flat surface of the pair of tabs. These surfaces cooperatively work with the holes in the shelf to secure the device and prevent the aforementioned problems.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
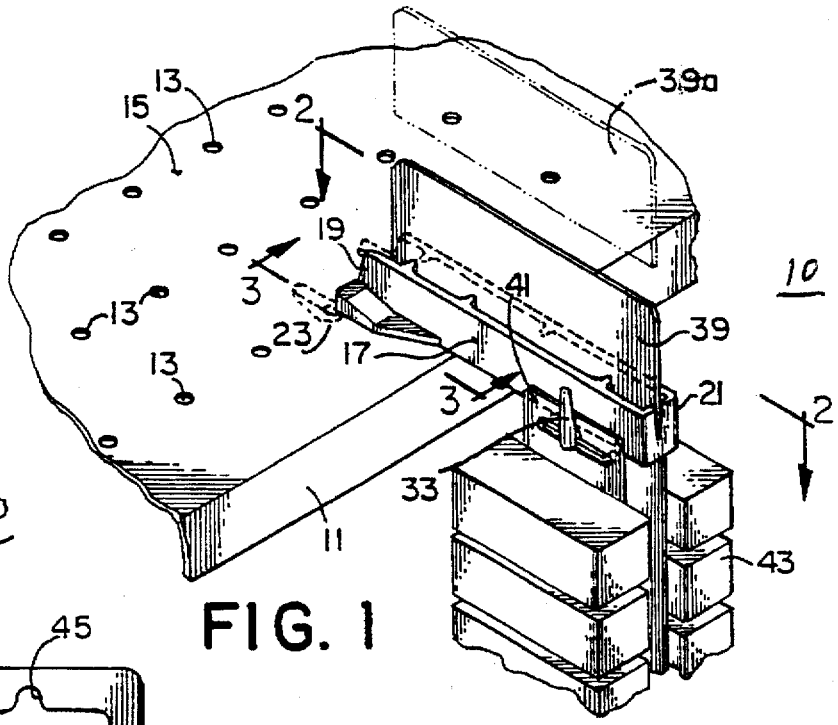
FIG. 1 is a perspective view, partially cut away, of the preferred embodiment, showing an advertising card inserted and a dot-dash line card removed, all in accordance with the invention.
Figure 4:
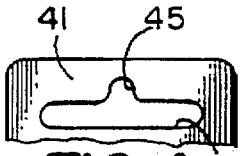
FIG. 4 is an enlarged, partially cutaway view of a product for use with the present invention.

As shown in the drawings, a shelf bracket, 10 generally, is useful for displaying products from shelves 11 having holes 13 on the top surface 15 of the shelves 11. The bracket 17 comprises an elongated body having a shelf engaging end 19 and an outer terminal end 21 extending out from shelf 11.

Figure 3:
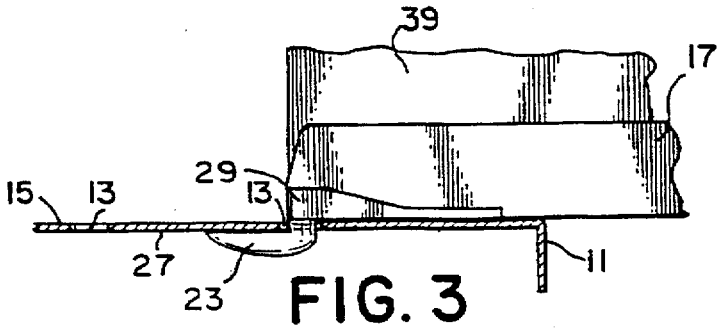
FIG. 3 is an enlarged, partially cut away, side elevational view of the device shown in FIG. 1, taken along the line 3—3.

Shelf engaging end 19 includes a pair of spaced apart tabs 23, shown in side elevational view in FIG. 3, that present a flat surface 25 against the underside 27 of shelf 11. Tabs 23 are attached to bracket body 17 via a flange 29 that presents a flat surface against the top surface 15 of shelf 11. The bracket 17 is installed on shelf 11 by inserting the pair of tabs 23 through adjacent holes 13 and rotating the body 10 so that the upper surface 25 of tabs 23 engages the underside 27 of shelf 11 and the flat surface of flange 29 engages the top surface 15 of shelf 11 so as to provide an extremely stable mounting assembly for bracket 17. The flat surface of flange 29 is preferably at least three times larger than the combined flat surface of the pair of tabs 23 in order to maximize stability. The importance of this mounting will become apparent hereinafter.

Also part of bracket 17 is a mounting platform 31 on the outer terminal end 21 for engagement with objects to be hung on or mounted on bracket 17. Extending perpendicularly out from platform 31 are a pair of hooks 33 which in turn extend vertically upward from the outer terminal end of each side of platform 31. Platform 31 and hooks 33 combine to provide a hook assembly that is intended to mate with the product being attached thereto. Specifically horizontal portion 31*a* of platform 31 has a substantial length to thickness ratio so as to provide a horizontal support to prevent rotation of the product being mounted about the axis of platform 31 that extends perpendicularly out from the bracket 17. Hook 33 extends vertically upward from platform portion 31*a* and includes a rib or raised portion 33*a* on top of platform 33, shown best in FIG. 2.

Figure 2:
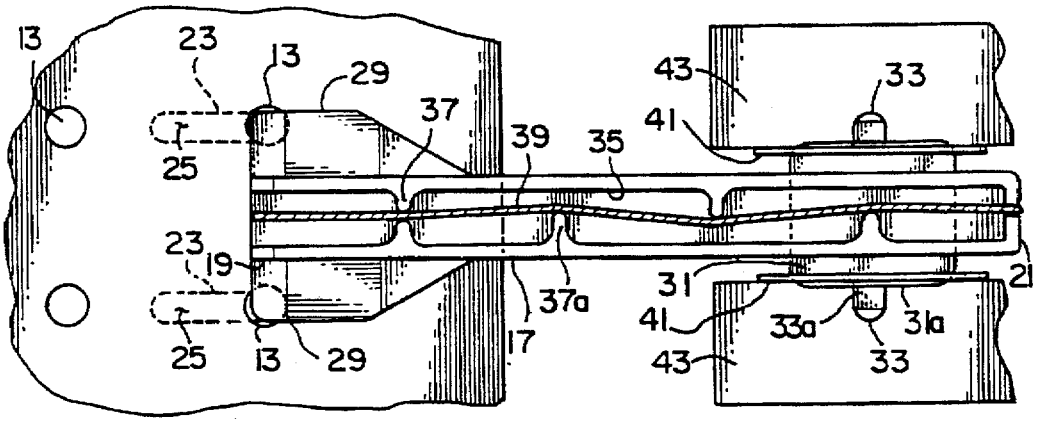
FIG. 2 is a plan view of the device shown in FIG. 1, taken along the line 2—2.

Bracket body 17 further includes a central passageway 35 that is hollow and which is provided with ribs 37 that define an axially aligned receptacle for engaging and detatchably holding advertising media 39. As shown in FIG. 2, the axially aligned path includes some ribs 37*a* that extend slightly past the axial center of the passageway 35 to engage the media 39 to prevent inadvertent removal thereof. Of course, store personnel may easily remove and replace advertising media 39*a* in FIG. 1 as new products are displayed on bracket 17, as desired.

The preferred product for which the bracket of this invention has been designed is known in the industry as a clip strip 41. These clip strips 41 have previously been hung from hooks directly on the shelves, thereby being subjected to constant disturbances by customers reaching behind the clip strip. In addition a clip strip attached directly to a shelf is not visible as the customer peruses goods while walking along the aisle. Nothing is present to catch the eye of a quickly walking impulse buyer.

The present invention, however, is admirably suited to attract impulse buyers and those passing along an aisle. The bracket body 17 extends out into the aisle, past the end of shelf 11, by a distance that is twice or more the width of the clip strip 41 so that product 43 is readily visible. Even though clip strip 41 extends out into the aisle, and presents both product 43 and advertising media 39 as a profile exposure to insure visibility before the potential customer reaches the point of sale.

Most clip strips 41 are provided with a hole 45 through which the strip is attached to a hook. Holes 45 also most often include a slot 47 that extends horizontally. This feature has been provided on clip strips so that a plurality of strips may be hung from a single hook that extends out from the shelf so that several clips may be on the same hook. This places the clip strip parallel to the shelf and gives the customer the opportunity to push the front clip strip aside to see what may be on the second strip. When used with the present invention, the clip strip hole 45 fits over the hook 33 of platform 31 and centers clip strip 41 on bracket 31. In addition, the slot 47 in clip strip 41 engages platform 31, such as at 31*a* in FIG. 2, to stabilize the clip strip 41 and prevent it from wearing hole 45. The engagement of platform 31 in slot 47 also provides a stable sense of permanence about the display and allows customers to remove products 43 without disturbing the display. Customer ease is an important factor in impulse purchasing and this feature of the present invention is effective in doing that.

While particular embodiments of the present invention have been illustrated and described, it is not intended to limit the invention, except as defined by the following claims.

We claim:

1. A device useful for displaying products from shelf having a plurality of holes on its top surface, comprising:

an elongated body having a shelf engaging end and an outer terminal end;

shelf engaging means on said shelf engaging end including a pair of spaced apart tabs extending away from said body configured to engage a pair of shelf holes and present a flat surface for contacting the underside of said shelf, said tabs including flange means for mounting said tabs on said body and providing a surface of engagement for contacting the top surface of said, shelf; and platform means located proximate said outer terminal end for supporting at least two hooks extending out from said body and upward for engaging said products, said platform means including slot engaging means associated therewith for engaging a slot in said products to prevent rotational movement of products about one of said at least two hooks;

said body including a central passageway axially aligned with the length of said body to present an axially aligned receptacle for engaging and detachably holding advertising media, wherein said central passageway includes at least one advertising media engaging rib extending slightly past the axial center of said passageway whereby a slight biasing curvature of said media is created which prevents inadvertent removal of said media.

2. The device of claim 1, wherein said surface of engagement is at least three times larger than the combined flat surface of said pair of tabs.

3. The device of claim 1, which includes a plurality of advertising media engaging ribs and advertising media comprising card stock having printing thereon.

4. The device of claim 1, further including a clip strip having a plurality of individual products thereon, said strip including a hole and slot means for attachment to said device, said one of at least two hooks engaging said hole and said platform means including a horizontally aligned rib for engaging said slot means to align said clip strip and prevent movement thereof about said one of said at least two hooks.

5. The device of claim 4, wherein said elongated body extends out from said shelf by at least twice the width of said clip strip, said hook and slot engaging means being positioned to align said clip strip with the outer terminal end of said body.

6. In combination, a clip strip holding a plurality of products land a device useful for displaying said clip strip from a shelf having a plurality of holes on its top surface, comprising:

an elongated body having a shelf engaging end and an outer terminal end extending from said shelf;

shelf engaging means on said shelf engaging end including a pair of spaced apart tabs extending away from said body configured to engage a pair of shelf holes and present a flat surface for contacting the underside of said shelf, said tabs including flange means for mounting said tabs on said body and providing a surface of engagement for contacting the top surface of said shelf; said surface of engagement being at least three times larger than the combined flat surfaces of said pair of tabs;

platform means located proximate said outer terminal end supporting at least two hooks extending out from said body and upward engaging said clip strip, said platform means including slot engaging means associated therewith engaging a slot in said clip strip to prevent rotational movement of said clip strip about one of said at least two hooks;

said body including a central passageway axially aligned with the length of said body to present an axially aligned receptacle for engaging and detachably holding advertising media, said central passageway includes at least one advertising media engaging rib extending slightly past the axial center of said passageway whereby a slight biasing curvature of said media Is created which prevents inadvertent removal of said media and;

said clip strip including a hole adjacent said slot for attachment to said device, said one of said at least two hooks engages said hole and said platform means including a horizontally aligned rib engaging for said slot to align said clip strip and prevent movement thereof about said one of said at least two hooks.

7. The combination of claim 6, wherein said elongated body extends out from said shelf by at least twice the width of said clip strip, said hook and slot engaging means being positioned to align said clip strip with the outer terminal end of said body.

8. The combination of claim 6, wherein said surface of engagement is at least three times larger than the combined flat surface of said pair of tabs.

9. The combination of claim 8, which includes a plurality of advertising media engaging ribs and advertising media comprising card stock having printing thereon.

* * * * *